US007813690B2

(12) United States Patent
Ichikawa et al.

(10) Patent No.: US 7,813,690 B2
(45) Date of Patent: Oct. 12, 2010

(54) CLEANING DEVICE

(75) Inventors: Tomoya Ichikawa, Kanagawa (JP); Shigeo Ohno, Kanagawa (JP); Masayuki Kono, Kanagawa (JP); Toshiyuki Matsui, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 830 days.

(21) Appl. No.: 11/717,189

(22) Filed: Mar. 13, 2007

(65) Prior Publication Data

US 2007/0217843 A1 Sep. 20, 2007

(30) Foreign Application Priority Data

Mar. 14, 2006 (JP) ..... P2006-069829

(51) Int. Cl.
*G03G 15/20* (2006.01)
*G03G 21/00* (2006.01)

(52) U.S. Cl. ..... 399/350; 399/326; 399/351; 399/358

(58) Field of Classification Search ..... 399/98, 399/99, 123, 350, 351, 358
See application file for complete search history.

(56) References Cited

U.S. PATENT DOCUMENTS 7,177,582 B2 * 2/2007 Ohta et al. ..... 399/350
7,505,729 B2 * 3/2009 Honda et al. ..... 399/349
2003/0152407 A1 * 8/2003 Hatano ..... 399/350
2006/0024100 A1 * 2/2006 Ohta et al. ..... 399/350
2006/0216082 A1 * 9/2006 Kojima ..... 399/350
2008/0226367 A1 * 9/2008 Kim et al. ..... 399/358

FOREIGN PATENT DOCUMENTS

JP 05072957 A * 3/1993
JP 11-161125 6/1999
JP 2001-75445 3/2001
JP 2007139927 A * 6/2007

* cited by examiner

*Primary Examiner*—David M Gray
*Assistant Examiner*—Francis Gray
(74) *Attorney, Agent, or Firm*—Morgan, Lewis & Bockius LLP

(57) ABSTRACT

A cleaning device removes a toner attached to an image carrier of an electrophotographic-type image forming apparatus. The cleaning device includes a cleaning blade, a housing and a block member. The cleaning blade is in contact with a surface of the image carrier to removes the toner. The housing stores the toner removed by the cleaning blade. The block member causes the toner to temporarily remain the toner in a vicinity of a distal end of the cleaning blade. The block member is formed of a sheet-shaped elastic member. One side of the block member is fixed to the housing. A repulsive force against bending in an end portion of the block member in a longitudinal direction is substantially smaller than a repulsive force against bending in a center portion of the block member.

11 Claims, 6 Drawing Sheets

CLEANING DEVICE

CROSS-REFERENCE TO RELATED APPLICATIONS

This application is based on and claims priority under 35 U.S.C. §119 from Japanese Patent Application No. 2006-069829 filed Mar. 14, 2006.

BACKGROUND

1. Technical Field

The invention relates to a cleaning device for use in an electrophotographic image forming apparatus, particularly a cleaning device that cleans a surface of an image carrier by contacting its cleaning blade to the surface of the image carrier.

2. Related Art

An electrophotographic image forming apparatus transfers toner, which is supplied to a photosensitive drum to develop an electrostatic latent image formed thereon, onto a recording medium such as a sheet of paper, or a transfer object such as an intermediate transfer body in the transfer process. However, some of toner remains on the photosensitive drum even after the transfer. When the residual toner remains until a next transfer process, the residual toner blocks optical discharge for the photosensitive drum in the process of exposing the photosensitive drum and causes an image defect. Therefore, a cleaning device is used to remove the residual toner on the photosensitive drum.

As a cleaning device, magnetic brush cleaners that use electrostatic energy, electrostatic brush cleaners, and magnetic roller cleaners that use magnetic energy have been in use in recent years. Further, other than the above cleaners, blade cleaners that use mechanical energy, brush cleaners, and web cleaners have also been on the market.

SUMMARY

According to an aspect of the invention, a cleaning device removes a toner attached to an image carrier of an electrophotographic-type image forming apparatus. The cleaning device includes a cleaning blade, a housing and a block member. The cleaning blade is in contact with a surface of the image carrier to removes the toner. The housing stores the toner removed by the cleaning blade. The block member causes the toner to temporarily remain the toner in a vicinity of a distal end of the cleaning blade. The block member is formed of a sheet-shaped elastic member. One side of the block member is fixed to the housing. A repulsive force against bending in an end portion of the block member in a longitudinal direction is substantially smaller than a repulsive force against bending in a center portion of the block member.

BRIEF DESCRIPTION OF THE DRAWINGS

Exemplary embodiments of the invention will be described below in detail with reference to the accompanying drawings, wherein.

DETAILED DESCRIPTION

Figure 1:
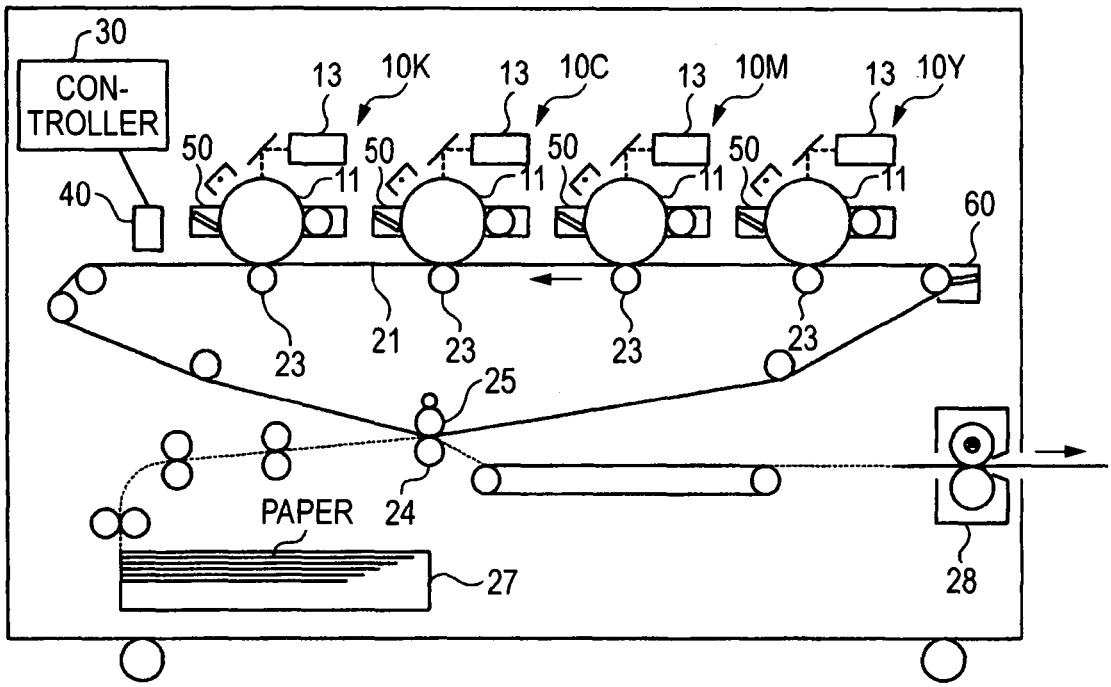
FIG. 1 shows an image forming apparatus to which an exemplary embodiment is applied.

FIG. 1 shows an image forming apparatus according to an exemplary embodiment.

The image forming apparatus is an electrophotographic-type and tandem-type digital color printer. As shown in FIG. 1, the image forming apparatus includes image forming sections 10 for forming images, exposure devices 13 having a printing function of forming electrostatic latent images on photosensitive drums 11 of the image forming sections 10, and a transfer belt 21 which serves as an intermediate transfer body and which carries toners with the toners being superimposed. The image forming sections 10 are provided so as to correspond to yellow Y, magenta M, cyan C, and black K, respectively. When it is necessary to distinguish the respective image forming sections 10, the image forming sections 10 will be designated by 10Y, 10M, 10C, 10K, respectively. On the other hand, if it is not necessary, the image forming sections are just designated by 10. First transfer rollers 23 are disposed inside the transfer belt 21 and at positions where the first transfer rollers 23 face the corresponding photosensitive drums 11 of the image forming sections 10, so as to carry images onto the transfer belt 21. Further, a second transfer roller 24 and a facing roller 25, which is disposed inside the transfer belt 21, are disposed at a second transfer position where toner images carried on the transfer belt 21 are transferred onto a sheet of paper. Further, the image forming apparatus includes a paper cassette 27 that accommodates sheets of paper, which are recording media, and a fixing device 28 that fixes the images transferred on to the sheet of paper. Also, the image forming apparatus includes a controller 30 that performs image processing for correcting misregistration and a color shift sensor 40 that reads a color-shift-control pattern formed in a predetermined region on the transfer belt 21.

The controller 30 generates a digital image signal of an image obtained from an input unit, such as IIT (Image Input Terminal), for inputting image data, and an image signal of a pattern image for color shift control and supplies the generated signals to the exposure device 13 so as to cause the exposure device 13 to write to the transfer belt 21. Further, the controller 30 obtains from the color shift sensor a result of detecting the color-shift-control pattern, analyzes an amount of color shift on the basis of the obtained information, and then performs required correction. These functions of the controller 30 may be implemented by a CPU (Central Processing Unit) controlled under a program, for example. The controller 30 includes non-volatile ROM (Read Only Memory) and a rewritable RAM (Random Access Memory) as memories. The ROM stores a software program for controlling the image formation process, the color shift detection process and the correction process, which are executed by the controller 30, and image information of the color-shift-control pattern. On the other hand, the RAM stores variety types of information, which are obtained by the operation of the image forming apparatus, such as various count values, number of times a job is executed, and execution information (time information) of the color-shift-detection process at the previous time.

A digital image signal, which is obtained by, for example, the image input terminal (IIT) or a personal computer (PC) and which is converted by an image processing device (not shown), are supplied to the exposure devices 13 for respective colors through the controller 30. The color shift sensor 40 is a reflective sensor which focuses the color-shift-control pattern (ladder-shaped toner patch and/or chevron patch) formed on the transfer belt 21 onto a detector formed of a PD (Photo Diode) sensor and which outputs a pulse when a center of gravity line of the patch matches a center line of the detector. To detect a relative color shift in the color-shift-control pattern formed of the patch formed by each image forming section 10, two color shift sensors 40 are disposed on the downstream of the most-downstream image forming section 10K and arranged in the main scanning direction. A light emitting section of the color shift sensor 40, for example, may include two infrared LEDs (wavelength 880 nm). In order to output pulses stably, the color shift sensors 40 are configured so that an amount of emitted light of the two LEDs are adjustable (for example, between 2 levels).

In the four-color image forming sections 10Y, 10M, 10C, 10K, various units used to form images are provided around the photosensitive drum 11, which are image carriers, in a similar manner. That is, the respective units such as a charging device, a developing device and a cleaning device 50 are provided. Te charging device charges the photosensitive drum 11. The developing device develops the photosensitive drum 11 exposed by the exposure device 13 to form a toner image. After the toner image is transferred to the transfer belt 21, the cleaning device 50 removes residual toner on the photosensitive drum 11. In addition to the image forming sections 10 for so-called regular colors, that is, yellow (Y), magenta (M), cyan (C) and black (K), a spot-color image forming section for a special image forming material such as a corporate color, which is not used in normal color-image formation, may be provided. Furthermore, five or more colors including dark yellow etc. as well as the four colors Y, M, C, K, may be used as regular colors. In this exemplary embodiment, a main scanning direction is defined as the axial direction of the photosensitive drum 11 serving as the image carrier, and a sub-scanning direction is defined as a movement direction of the photosensitive drum 11. The movement of the photosensitive drum 11 is caused by its rotation.

The transfer belt 21 may be an endless belt obtained by forming a synthetic resin film, such as a flexible polyimide, into a belt and then connecting both ends by welding. A driving roll and a driven roller stretch at least a portion of the transfer belt 21 straightly. Along the substantially straight portions of the transfer belt 21, the four image forming sections 10Y, 10M, 10C, 10K and the corresponding first transfer rollers 23 are arranged at predetermined horizontal intervals. In the exemplary embodiment shown in FIG. 1, the yellow image forming section 10Y, the magenta image forming section 10M, the cyan image forming section 10C, and the black image forming section 10K are sequentially disposed from the upstream to the downstream in a direction in which the transfer belt 21 moves when transferring. As the transfer belt 21 moves, images of the respective colors formed by the image forming sections 10 are sequentially overlapped on the transfer belt 21. Thereby, color toner images are formed on the transfer belt 21. The color toner images on the transfer belt 21 are transferred onto a sheet of paper at the position where the second transfer roller 24 and the facing roller 25 are disposed, so that a conveyance timing of the sheet of paper matches a movement timing of the transfer belt 21. Thereafter, the sheet of paper with the color toner images transferred thereon is conveyed to the fixing device 28. Then, the fixing device 28 fixes the color toner images onto the sheet of paper, and then the sheet of paper is discharged to a discharge tray, which is disposed outside a housing of the image forming apparatus.

As described above, the color toner images are sequentially transferred onto the transfer belt 21 from the image forming sections 10Y, 10M, 10C, 10K and then transferred onto the sheet of paper. Accordingly, because some toner remains on the transfer belt 21 in this process, the cleaning device 60 is provided to remove the residual toner. Furthermore, depending on the configuration of the image forming apparatus, when color toner images are formed on a transfer roller, an appropriate cleaning device may be provided for such a intermediate transfer body (e.g., the transfer roller), if necessary. The cleaning device for removing residual toner is not only provided in color printing machines, but also provided in a general image forming apparatus of the electrophotographic type including a monoclonal printing machine.

In this exemplary embodiment, the cleaning devices 50, 60 remove residual toner by bringing a cleaning blade into contact with the photosensitive drums 11 and the transfer belt 21. Furthermore, it is assumed that the configuration of the cleaning device 50 is similar to that of the cleaning device 60. Therefore, the cleaning device 50 will be described hereinbelow.

In the cleaning device 50, noise may be caused by minute vibration due to friction at a contact portion between the photosensitive drum 11 and the cleaning blade. When the cleaning blade bends back or its distal end is deteriorated, cleaning failure may occur. Therefore, the cleaning device 50 causes the removed wasted-toner to temporarily remain in the vicinity of the distal end of the cleaning blade and uses the remaining toner as a lubricant in the contact portion between the photosensitive drum 11 and the cleaning device 50.

Figure 2:
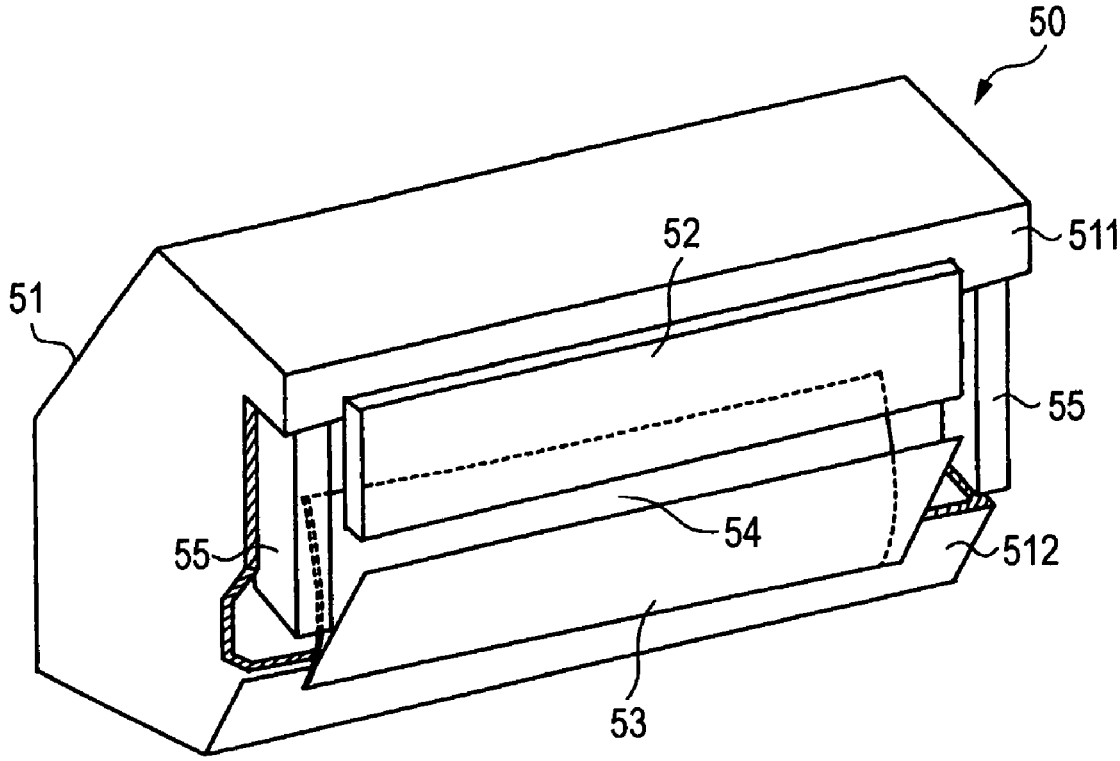
FIG. 2 shows the configuration of a cleaning device according to the exemplary embodiment.
Figure 3:
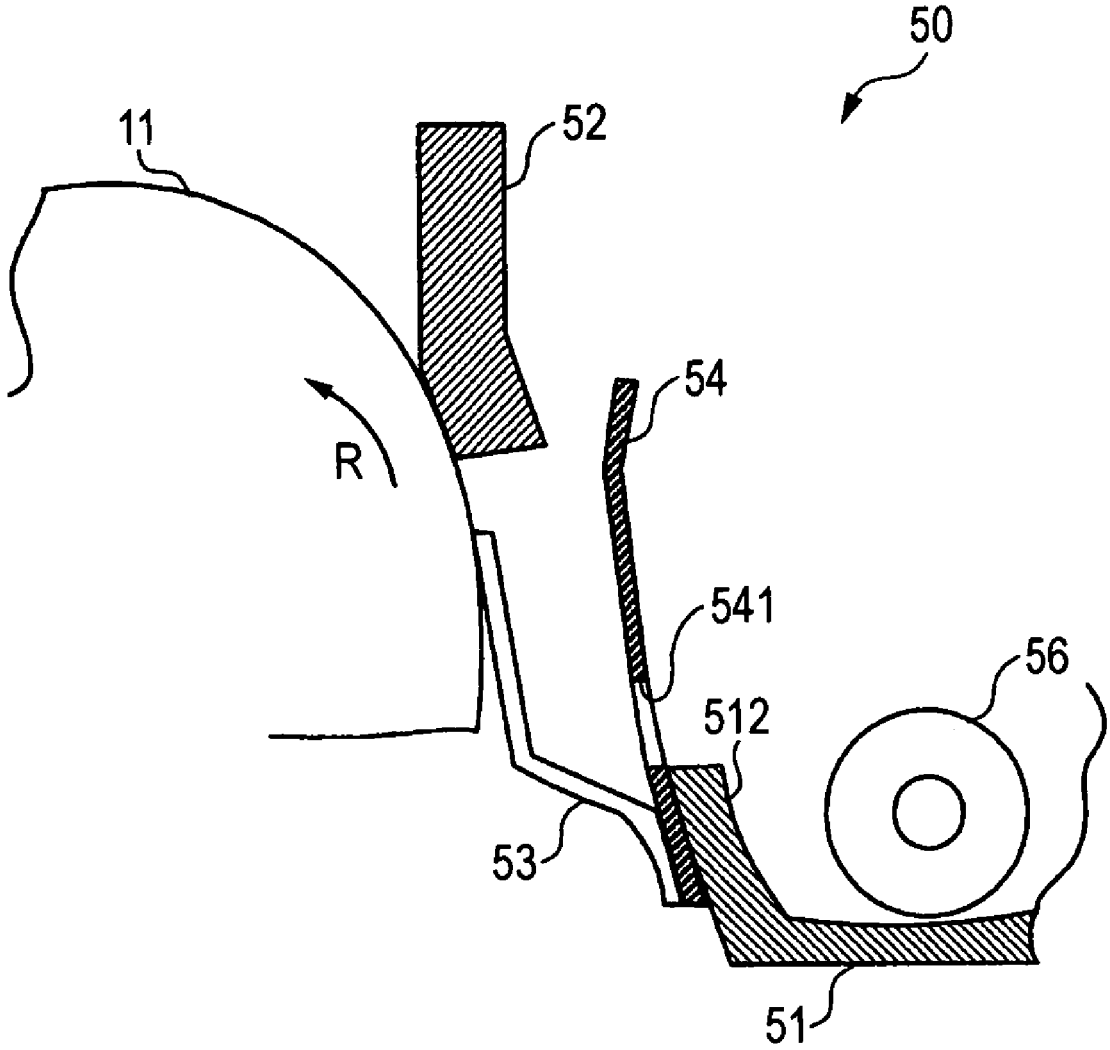
FIG. 3 shows the configuration for causing a wasted toner to temporarily remain and using the remaining wasted toner as a lubricant.
Figure 4:
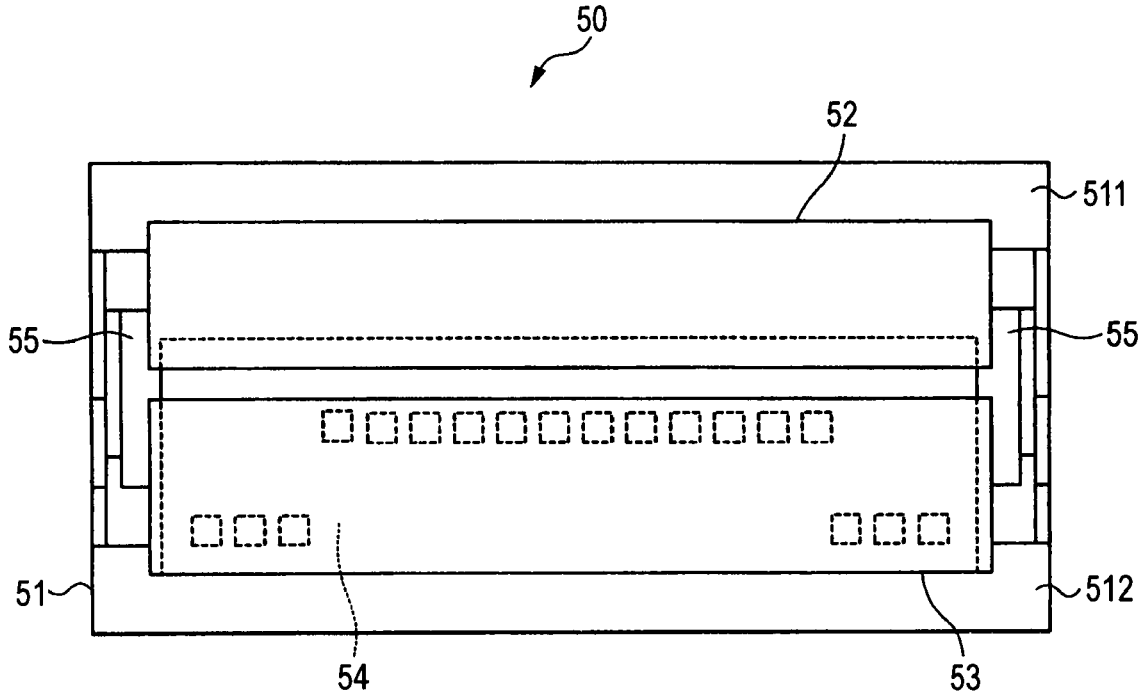
FIG. 4 is a front view of main parts of the cleaning device shown in FIG. 2.

FIG. 2 shows the configuration of the cleaning device 50 according to this exemplary embodiment. FIG. 3 shows the configuration for causing the wasted toner to temporarily remain and using the remaining toner as a lubricant in the cleaning device 50. FIG. 4 is a front view of main parts of the cleaning device 50 shown in FIG. 2.

Referring to FIGS. 2 to 4, the cleaning device 50 according to the exemplary embodiment includes a housing 51, a cleaning blade 52, a toner receiving seal 53 and a block sheet 54. The housing 51 stores wasted toner removed from the surface of the photosensitive drum 11. The cleaning blade 52 scrapes and removes residual toner on the surface of the photosensitive drum 11. The toner receiving seal 53 receives the wasted toner removed by the cleaning blade 52. Furthermore, the cleaning device 51 includes side seals 55 that prevent wasted toner scraped and removed by the cleaning blade 52 from leaking out in the lateral direction and an auger 56 that conveys wasted toner stored in the housing 51 to a discharge port (not shown) for discharging the toner outside the housing 51.

The housing 51 is arranged in parallel to the photosensitive drum 11, and is formed with an opening on a side facing the photosensitive drum 121. In FIGS. 2 to 4, an upper edge portion of the opening of the housing 51 is referred to as an upper edge 511, and its lower edge portion is referred to as a lower edge 512. In other words, in terms of the moving (rotating) direction of the surface of the photosensitive drum, the upper edge 511 is located on the downstream side and the lower edge 512 is located on the upstream side. The cleaning blade 52 is disposed at the upper edge 511, and the toner receiving seal 53 is disposed at the lower edge 512.

The cleaning blade 52 is a plate member having a length substantially equal to (corresponding to) the axial length of the photosensitive drum 11. One side (hereafter, referred to as a "fixed side"), along a longitudinal direction, of the cleaning blade 52 is fixed to the upper edge 511 of the opening of the housing 51. The cleaning blade 52 may be fixed by an appropriate means such as adhesive or threaded-fastening. On the other hand, the other side of the cleaning blade 52, which is not fixed to the housing 51 (hereafter, referred to as a "free side" or "distal end"), is in contact with the surface of the photosensitive drum 11 in an opposite direction regarding the rotation direction of the photosensitive drum 11. This way of contact is called a "doctor blade" or a "doctor knife type." The cleaning blade 52 is made of an elastic resin, for example, a urethane rubber having 2 mm in thickness. Thereby, when the distal end of the cleaning blade 52 contacts with the surface of the photosensitive drum 11 and is pressed, the cleaning blade 52 deforms toward to the inside of the housing 51 and maintains being in close contact with the photosensitive drum 11 by the repulsive force. Therefore, the free end of the cleaning blade 52 scrapes and removes residual toner on the surface of the photosensitive drum 11.

The toner receiving seal S3 is formed of a thin film member having a length substantially equal to (corresponding to) the axial length of the photosensitive drum 11. One side (hereafter, referred to as a "fixed side"), in the longitudinal direction, of the toner receiving seal 53 is fixed to the lower edge 512 of the opening of the housing 51 as described above. The toner receiving seal 53 may be fixed by an appropriate means such as adhesive or threaded-fastening. On the other hand, the other side of the toner receiving seal 53, which is not fixed to the housing 51 (hereafter, referred to as a "free end"), is in contact with the photosensitive drum 11 along the rotation direction of the photosensitive drum 11. The toner receiving seal 53 is made of a flexible resin such as a polyurethane resin having 20 μm in thickness. Accordingly, when the distal end of the toner receiving seal 53 contacts with the surface of the photosensitive drum 11 and is pressed, the toner receiving seal 53 deforms toward the inside of the housing 51 and maintains being in close contact with the photosensitive drum 11 by the repulsive force. Further, the toner receiving seal 53 is disposed so that a gap is formed between the free side of the toner receiving seal 53 and the free side of the toner blade 52. Wasted-toner removed by the free end of the cleaning blade 52 is guided through the gap to the inside of the cleaning blade 52 and the toner receiving seal 53. As a result, the wasted-toner is prevented from leaking outside to the upstream in the rotation direction of the photosensitive drum 11.

The block sheet 54 is a long sheet-shaped member having a length substantially equal to (corresponding to) the axial length of the photosensitive drum 11. A longitudinal side of the block sheet 54 (hereafter, referred to as a "fixed side") is fixed between the lower edge 512 of the opening of the housing 51 and the inside of the toner receiving seal 53. The block sheet 54 may be fixed by an appropriate means such as adhesive or threaded-fastening. On the other hand, in the initial state, the other side of the block sheet 54, which is not fixed to the housing 51, overlaps and is in contact with the inside of the free side of the cleaning blade 52. When an amount of toner entering a space between the toner receiving seal 53 and the block sheet 54 exceeds an amount of toner discharge through holes 541 of the block sheet 54, the other side of the block sheet 54 detaches from the free side of the cleaning blade 52 and then the toner is discharged into the inside of the housing 51 through a gap between the other side of the block sheet 54 and the free side of the cleaning blade 52 as well as through the holes 541. The opening of the housing 51 is covered by the block sheet 54 and the cleaning blade 52. Therefore, wasted-toner scraped and removed by the cleaning blade 52 is caused to remain in a space defined by the cleaning blade 52, the toner receiving seal 53 and the block sheet 54. The block sheet 54 is made of a flexible resin, for example, a polyethylene terephthalate resin having 50 μm in thickness.

The block sheet 54 is formed with a row of holes, which are arranged along the longitudinal direction. As described above, the block sheet 54 is provided to cause wasted-toner scraped and removed by the cleaning blade 52 to temporarily remain in the vicinity of the distal end of the cleaning blade 52, but not to directly discharge the wasted toner to the inside of the housing 51. However, when a too large amount of the removed wasted-toner is accumulated, the accumulated wasted-toner may leak out through between the toner receiving seal 53 and the block sheet 54 or slip through the cleaning blade 52. As a result, the wasted toner may contaminate the photosensitive drum 11. In order to keep an amount of the wasted toner accumulated by the block sheet 54 being an appropriate amount, excess wasted toner may be discharged. Then, in this exemplary embodiment, the holes are formed in the block sheet 54. Thereby, a part of the wasted-toner accumulated in the block sheet 54 is discharged into the inside of the housing 51 through the holes so as to keep the amount of the accumulated wasted-toner being an appropriate amount. Also, a foreign substance such as a carrier having a large density is discharged to the housing 51 through the holes immediately, to thereby prevent the foreign substance from entering between the cleaning blade 52 and the photosensitive drum 11 and prevent the photosensitive drum 11 and the cleaning blade 52 from being damaged and/or broken.

The side seals 55 are fixed to plates extending from side plates of the housing 51 and disposed at both ends of the cleaning blade 52. With this structure, the side seals 55 prevent wasted-toner scraped and removed by the cleaning blade 52 from leaking out through the sides of the cleaning blade 52. Further, the side seals 55 are disposed so that slight gaps (1 to 2 mm) are formed between the side seals 55 and the block sheet 54. The gaps prevent such a phenomenon that the pressure of the wasted toner presses the side seals 55 to deteriorate sealing property of the side seals 55. Each side seals 55 may be formed of a wool base layer and a felt surface layer made of a fluorine resin.

The conveyance auger 56 is disposed in a lower portion of the housing 51. The conveyance auger 56 pushes wasted toner scraped and removed by the cleaning blade 52 toward one side in the housing 51 and discharges the wasted toner outside the housing 51.

According to the above structure, while removing residual toner from the photosensitive drum 11, the cleaning device 50 temporarily accumulates the wasted toner, so that the toner can be used as a lubricant for the contact portion between the photosensitive drum 11 and cleaning blade 52. However, the cleaning blade 52 and the block sheet 54 are generally longer than a width of an image forming region (may be referred to as a "developable region" or a "magnet roll") of the photosensitive drum 11. Therefore, the residual toner is removed and always supplied as a lubricant to a position of the cleaning blade 52 corresponding to the image forming region, while the wasted toner is not sufficiently supplied to end portions of the cleaning blade 52 corresponding to the outside of the image forming region. Minute vibration may be occurs at the distal end of the cleaning blade 52 in such end portions or the distal end of the cleaning blade 52 may bend back in such end portions, which cause cleaning failure. This exemplary embodiment devises to supply wasted-toner obtained at a portion of the cleaning blade 52 substantially corresponding to the image forming region to the end portions. Hereinafter, the portion of the cleaning blade 52 substantially corresponding to the image forming region will be referred to as a "center portion," in contrast to the end portions. Similarly, a portion of the toner receiving seal 53 and a portion of the block sheet 54, which substantially correspond to the image forming region of the photosensitive drum 11, will be referred to as a "center portion" of the toner receiving seal 53 and a "center portion" of the block sheet 54. Also, portions of the toner receiving seal 53 and portions of the block sheet 54, which substantially correspond to the outside of the image forming region of the photosensitive drum 11, will be referred to as "end portions" of the toner receiving seal 53 and "end portions" of the block sheet 54. Specifically, the block sheet 54 is configured so that a repulsive force, against bending, in the end portions of the block sheet 54 is smaller than that in the center portion of the block sheet 54. Thereby, the end portions of the block sheet 54 bends more than the center portion of the block sheet 54 bends, so that wasted-toner in the center portion flows to the end portions. Specific configuration examples will be described below in detail.

CONFIGURATION EXAMPLE 1

As described above, according to the above exemplary embodiment, in order to supply the wasted-toner at the center portion to the end portions, a repulsive force against bending in the end portions is set smaller than that in the center portion so that the end portions of the block sheet 54 bend more easily than the center portion of the block sheet bends. In this configuration example 1, the center portion and the end portions are different in positions of the plural holes of the block sheet 54 arranged along the longitudinal direction. Specifically, the holes in the end portions are located closer to the fixed side, which is fixed to the housing, than those in the center portion.

Figure 5:
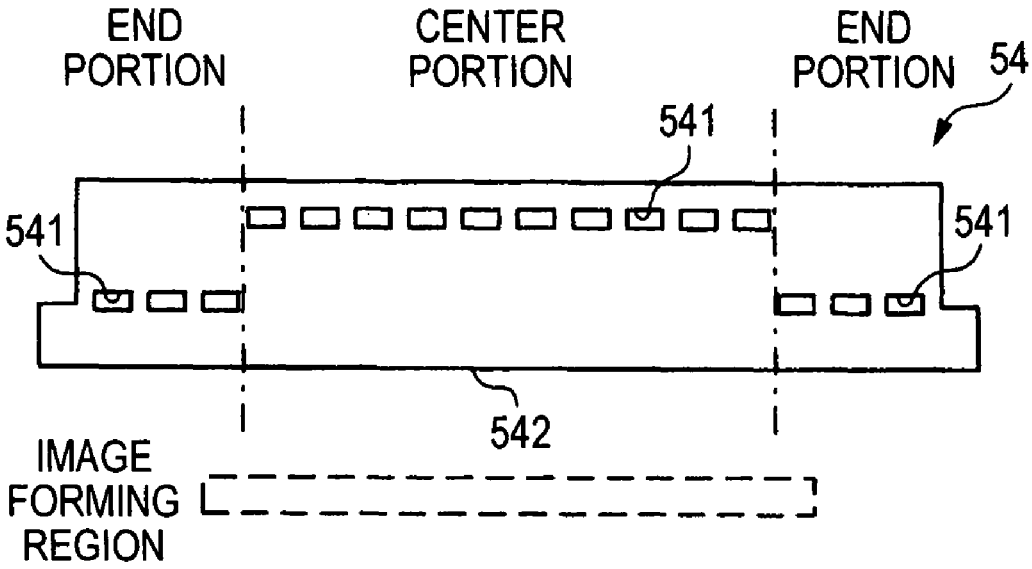
FIG. 5 shows the configuration of a block sheet according to a configuration example 1.

FIG. 5 shows the configuration of the block sheet 54 of the configuration example 1.

As shown in FIG. 5, the holes 541 of the block sheet 54 are disposed at a constant distance from the fixed side 542 in the center portion, and the holes 541 in the end portions are disposed closer to the fixed side 542. Each hole 541 has about 3 mm×about 9 mm. As described above, the block sheet 54 is formed of the elastic material, but the elasticity does not work at the portion where the holes 541 are formed. For this reason, in the end portions where the holes 541 are disposed close to the fixed side 542, when force to bend the end portions is applied, a repulsive force against the bending force is smaller than a repulsive force in the center portion. When wasted-toner scraped and removed by the cleaning blade 52 is accumulated and a pressing force for bending the block sheet 54 toward the inside of the housing 51 acts, the end portions bend more than the center portion.

Since the repulsive force against bending is smaller in the end portions of the block sheet 54 than that in the center portion of the block sheet 54, the wasted-toner obtained in the center portion is gradually drifted to the end portions. Thereby, the wasted toner used as a lubricant is always supplied to the end portions. Further, since the end portions of the block sheet 54 bends more than the center portion bends, the space defined by the cleaning blade 52, the toner receiving seal 53, and the block sheet 54 becomes wider in the end portions than in the center portion. Therefore, the wasted toner more easily remains in the end portions.

Further, as shown in FIG. 5, among the holes 541, which are in the end portions and disposed in the vicinity of the fixed side 542, one to a few holes on the center-portion side may overlap the image forming region of the photosensitive drum 11. In other words, a boundary (indicated by one-dot-chain lines) between the center portion and the end portions of the block sheet 54 shifts a little from the actual image forming region (indicated by dashed lines) of the photosensitive drum 11 to the inside, and parts of the end portions overlap the image forming region. With this configuration, residual toner in the image forming region is scraped and removed by the cleaning blade 52 even in the end portions.

The operation of the cleaning device 50 having the block sheet 54 of the configuration example 1 will be described.

First, the photosensitive drum 11 rotates in the direction of an arrow R, that is, in the counterclockwise direction as shown in FIG. 3. An image formed on the photosensitive drum 11 by the exposure device 13 and the image forming sections 10 are transferred onto the transfer belt 21. Not all of the images are transferred to the transfer belt 21 and a little amount of toner remains on the photosensitive drum 11. As the photosensitive drum 11 rotates, the residual toner on the photosensitive drum 11 is scraped and removed by the distal end of the cleaning blade 52 of the cleaning device 50, which is in contact with the photosensitive drum 11.

The wasted toner scraped and removed from the photosensitive drum 11 is accumulated between the toner receiving seal 53 and the block sheet 54. Thereby, a pressing force acts in a direction from the photosensitive drum 11 toward the inside of the housing and the elastic block sheet 54 bends toward the inside of the housing 51. At this time, in the end portions of the block sheet 54, the holes 541 are located in the vicinity of the fixed side 542, which is fixed to the housing 51. Therefore, a repulsive force against the pressing force is small and the end portions of the block sheet 54 bends larger than the center portion bends. As a result, the wasted-toner in the center portion corresponding to the image forming region of the photosensitive drum 11 is gradually drifted to the end portions.

The specific size and specific position of the holes 541 (how far the holes 541 are disposed from the fixed side 542) may be determined appropriately, depending on a material of the block sheet 54, a shape of the block sheet 54, performance of the image forming apparatus and the usage environment.

CONFIGURATION EXAMPLE 2

Figure 6:
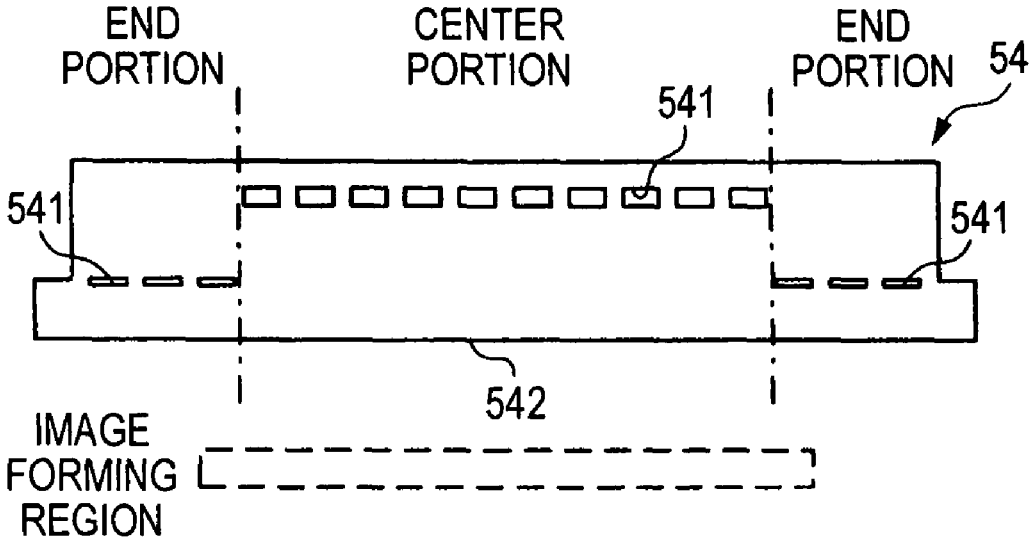
FIG. 6 shows the configuration of a block sheet according to a configuration example 2.

FIG. 6 is shows the configuration of the block sheet 54 according to a configuration example 2.

As shown in FIG. 6, in the configuration example 2, the holes 541 in the center portion of the block sheet 54 are disposed at constant distances from the fixed side 542, and the holes 541 in the end portions are disposed in the vicinity of the fixed side 542. The positional relationship in the configuration example 2 is the same as that in the configuration example 1. On the other hand, according to the configuration example 2, the holes 541 in the end portions are smaller in size than those in the center portion. Specifically, the dimension of each hole 541 in the center portion is about 3 mm×about 9 mm and the dimension of each hole 541 in the end portions is about 2 mm×about 6 mm. Since the holes 541 in the end portions are smaller than those in the center portion, an amount of wasted toner, which is discharged from the end portions of the block sheet 54 into the housing 51, can be reduced.

In the configuration example 2, a size of each hole 541 of the block sheet 54 is made small. Thereby, in the end portions, the wasted toner discharged into the inside of the housing is limited so as to cause an appropriate amount of the wasted toner to remain.

The specific size and specific position of the holes 541 (how far the holes 541 are disposed from the fixed side 542) may be determined appropriately, depending on a material of the block sheet 54, a shape of the block sheet 54, performance of the image forming apparatus and the usage environment. As shown in FIG. 6, in this configuration example 2, a boundary (indicated by one-dot-chain lines) between the center portion and the end portions of the block sheet 54 may shift a little from the actual image forming region (indicated by dashed lines) of the photosensitive drum 11 to the inside, and parts of the end portions may overlap the image forming region.

Further, the holes 541 of the block sheet 54 are reduced in size, which reduces the effect that the positions of the holes 541 in the end portions weaken the repulsive force against bending in the end portions. However, influence of the difference in size of the holes 541 on the repulsive force is less than influence of the difference in position of the holes 541 on the repulsive force. Therefore, reducing of the holes 541 in the end portions cause no problem.

CONFIGURATION EXAMPLE 3

Figure 7:
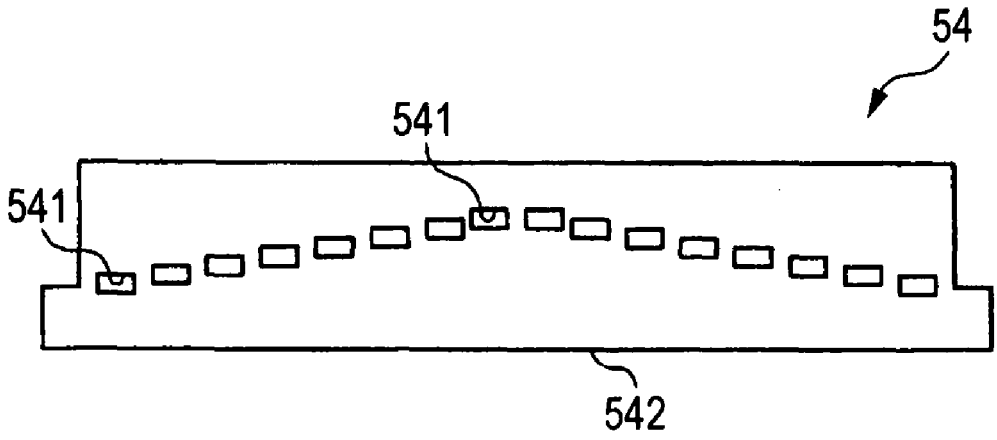
FIG. 7 shows the configuration of a block sheet according to a configuration example 3.

FIG. 7 shows the configuration of the block sheet 54 according to a configuration example 3.

As show in FIG. 7, in the configuration example 3, the holes 541 of the block sheet 54 are disposed so that the holes 514 come closer to the fixed side 542 as advancing from the center portion to each end portion. Since the holes 541 come closer to the fixed side 542 as advancing from the center portion to each end portion, a repulsive force in the end portions against the force to bend the block sheet 54 is smaller that in the center portion as in the configuration examples 1 and 2.

CONFIGURATION EXAMPLE 4

Figure 8:
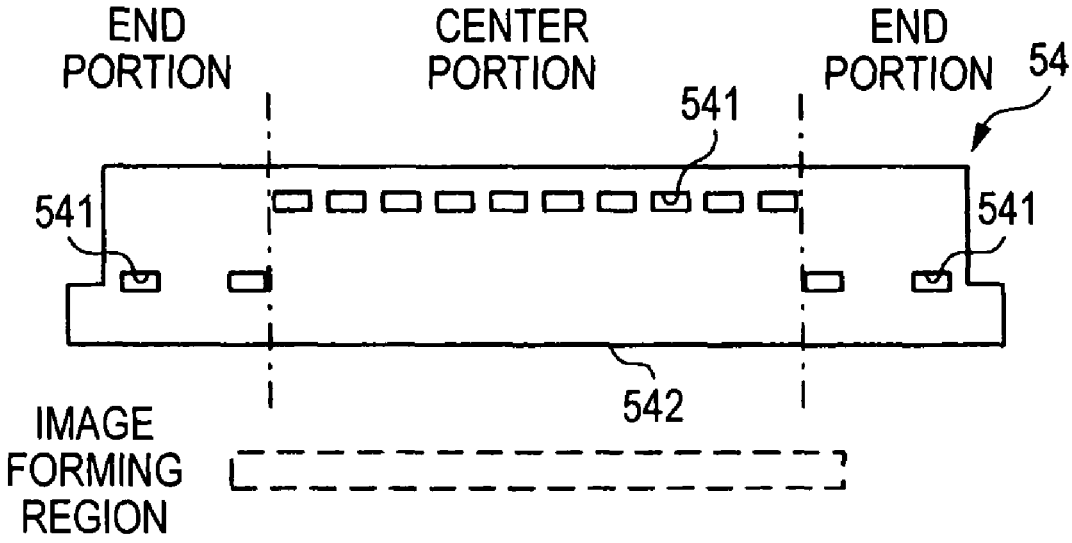
FIG. 8 shows the configuration of a block sheet according to a configuration example 4

FIG. 8 shows the configuration of the block sheet 54 according to a configuration example 4.

As shown in FIG. 8, the holes 541 in the center portion of the block sheet 54 are disposed at a constant distance from the fixed side 542, and the holes 541 in the end portions are disposed in the vicinity of the fixed side 542. This positional relationship is the same as in the configuration example 1. On the other hand, in the configuration example 4, the holes 541 in the end portions are disposed at predetermined intervals (pitches), which is larger than intervals in the center portion. The fact that the intervals in the end portions are larger means that number of the holes 541 in a predetermined area is smaller.

The specific size and specific position of the holes 541 (how far the holes 541 are disposed from the fixed side 542) may be determined appropriately, depending on a material of the block sheet 54, a shape of the block sheet 54, performance of the image forming apparatus and the usage environment. As shown in FIG. 6, in this configuration example 2, a boundary (indicated by one-dot-chain lines) between the center portion and the end portions of the block sheet 54 may shift a little from the actual image forming region (indicated by dashed lines) of the photosensitive drum 11 to the inside, and parts of the end portions may overlap the image forming region.

The specific size and specific position of the holes 541 (how far the holes 541 are disposed from the fixed side 542) may be determined appropriately, depending on a material of the block sheet 54, a shape of the block sheet 54, performance of the image forming apparatus and the usage environment. As shown in FIG. 6, in this configuration example 2, a boundary (indicated by one-dot-chain lines) between the center portion and the end portions of the block sheet 54 may shift a little from the actual image forming region (indicated by dashed lines) of the photosensitive drum 11 to the inside, and parts of the end portions may overlap the image forming region.

The block sheet 54 is described above with reference to the four configuration examples. However, the invention is not limited to thereto. Specifically, the invention includes what realizes such a technical idea that a repulsive force, against bending, in the end portions of the block sheet 54 is smaller than that in the center portion to thereby flow the wasted toner in the center portion to the end portions.

Two or more of the above examples may be combined appropriately. For example, the holes 541 in the end portions may be made small while intervals between the holes 541 in the end portions are widened (a combination of the configuration examples 2 and 4). The size of the holes of the block sheet 54 may be decreased gradually as advancing from the center portion to the end portions. Also, intervals between the holes 541 of the block sheet 54 may be widened gradually as advancing from the center portion to the end portions. In any case, the specific size and specific position of the holes 541 (how far the holes 541 are disposed from the fixed side 542) may be determined appropriately, depending on a material of the block sheet 54, a shape of the block sheet 54, performance of the image forming apparatus and the usage environment.

In the above exemplary embodiment, the cleaning device 50 provided for the photosensitive drum is described as an example. However, the exemplary embodiment is applicable to cleaning devices for a variety of transfer body of electrophotographic image forming apparatuses, including the cleaning device 60 for the transfer belt 21 shown in FIG. 1 is The foregoing description of the exemplary embodiments of the invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning device for removing a toner attached to an image carrier of an electrophotographic-type image forming apparatus, the cleaning device comprising:

a cleaning blade that is in contact with a surface of the image carrier to remove the toner;

a housing that stores the toner removed by the cleaning blade; and a block member that causes the toner to temporarily remain in a vicinity of a distal end of the cleaning blade, the block member being formed of a sheet-shaped elastic member, one side of the block member being fixed to the housing, wherein the block member defines a plurality of holes that are arranged along a longitudinal direction, and the holes are positioned in a widthwise direction of the block member so that the holes in an end portion in the longitudinal direction are nearer than the one side fixed to the housing than the holes in a center portion, and the end portion of the block member, in the longitudinal direction, exerting a repulsive force that is substantially smaller than a repulsive force exerted by the center portion of the block member.

2. A cleaning device for removing a toner attached to an image carrier of an electrophotographic-type image forming apparatus, the cleaning device comprising:

a cleaning blade that is in contact with a surface of the image carrier to remove the toner;

a housing that stores the toner removed by the cleaning blade; and a block member that causes the toner to temporarily remain in a vicinity of a distal end of the cleaning blade, the block member being formed of a sheet-shaped elastic member, one side of the block member being fixed to the housing, and, a shape of the block member in a center portion being different from a shape of the block member in an end portion so that the toner removed by the cleaning blade in the center portion is gradually carried away toward the end portion, wherein the block member defines a plurality of holes that are arranged along a longitudinal direction, and the holes are positioned in a widthwise direction of the block member so that the holes in the end portion in the longitudinal direction are nearer than the one side fixed to the housing than the holes in the center portion, and the end portion of the block member, in the longitudinal direction, exerting a repulsive force that is substantially smaller than a repulsive force exerted by the center portion of the block member.

3. The device according to claim 2, wherein the holes gradually come closer to the side fixed to the housing as advancing from the center portion to the end portion in the longitudinal direction.

4. A cleaning device for removing a toner attached to an image carrier of an electrophotographic-type image forming apparatus, the cleaning device comprising:

a cleaning blade that is in contact with a surface of the image carrier to remove the toner;

a housing that stores the toner removed by the cleaning blade; and a block member that causes the toner to temporarily remain in a vicinity of a distal end of the cleaning blade, the block member being formed of a sheet-shaped elastic member, one side of the block member being fixed to the housing, and wherein a plurality of holes located in an end portion in a longitudinal direction are substantially smaller in size than the holes located in a center portion.

5. A cleaning device for removing a toner attached to an image carrier of an electrophotographic-type image forming apparatus, the cleaning device comprising:

a cleaning blade that is in contact with a surface of the image carrier to remove the toner;

a housing that stores the toner removed by the cleaning blade; and a block member that causes the toner to temporarily remain in a vicinity of a distal end of the cleaning blade, the block member being formed of a sheet-shaped elastic member, one side of the block member being fixed to the housing, and wherein intervals between a plurality of holes located in an end portion in a longitudinal direction are substantially larger intervals between the holes located in a center portion.

6. The device according to claim 2, wherein parts of the holes of the block sheet that are closer to the side fixed to the housing overlap, an image forming region of the image carrier when viewed from the image carrier to the housing.

7. A cleaning device for removing a toner attached to an image carrier of an electrophotographic-type image forming apparatus, the cleaning device comprising:

a cleaning blade that extends in a direction perpendicular to a rotation direction of the image carrier, the cleaning blade being disposed to face an opposite direction regarding a rotation direction of the image carrier;

a housing formed with an opening portion on a side facing the image carrier, the cleaning blade being fixed to an upper edge of the housing above the opening portion; and a sheet-shaped block member disposed in the opening portion of the housing and fixed to a lower edge of the housing so as to face the cleaning blade, the block member being disposed on an inner side of the lower edge of the housing than the cleaning blade, the block member having a length substantially larger than a width of an image forming region of the image carrier, the block member having at least two longitudinal sides extending in a longitudinal direction, an end portion of the block member, in the longitudinal direction, exerting a repulsive force that is substantially smaller than a repulsive force exerted by a center portion of the block member, wherein the block member defines a plurality of holes that are arranged along the longitudinal direction, and the holes are positioned in a widthwise direction of the block member so that the holes in the end portion in the longitudinal direction are nearer than the one side fixed to the housing than the holes in the center portion.

8. The device according to claim 7, wherein:

one of the longitudinal sides of the block member is fixed to the housing, and the holes are positioned in the widthwise direction of the block member so that the holes gradually come closer to the side fixed to the housing as advancing from the center portion to the end portion in the longitudinal direction.

9. The device according to claim 7, wherein the holes located in the end portion in the longitudinal direction are substantially smaller in size than those located in the center portion.

10. The device according to claim 7, wherein intervals between the holes located in the end portion in the longitudinal direction are larger intervals between the holes located in the center portion.

11. The device according to claim 7, wherein parts of the holes of the block sheet that are closer to the side fixed to the housing, overlap the image forming region of the image carrier when viewed from the image carrier to the housing.

* * * * *